US005151169A

United States Patent [19]

Galyon et al.

[11] Patent Number: 5,151,169

[45] Date of Patent: Sep. 29, 1992

[54] CONTINUOUS ANODIZING OF A CYLINDRICAL ALUMINUM SURFACE

[75] Inventors: George T. Galyon, Fishkill; George M. Jordhamo, Wappingers Falls; Louis H. Wirtz, Highland, all of N.Y.

[73] Assignee: International Business Machines Corp., Armonk, N.Y.

[21] Appl. No.: 802,792

[22] Filed: Dec. 6, 1991

[51] Int. Cl.[5] ..... C25D 11/04; C25D 17/00

[52] U.S. Cl. ..... 205/151; 204/224 R

[58] Field of Search ..... 205/151; 204/224 R

[56] References Cited

U.S. PATENT DOCUMENTS

| | | | |
|---|---|---|---|
| 2,700,212 | 1/1955 | Flynn et al. | 428/623 |
| 3,008,892 | 11/1961 | Owen | 204/207 |
| 4,226,281 | 10/1980 | Chu | 165/80.2 |
| 4,772,361 | 9/1988 | Dorsett et al. | 204/28 |
| 4,948,487 | 8/1990 | Imazu et al. | 204/206 |

*Primary Examiner*—T. M. Tufariello

*Attorney, Agent, or Firm*—Floyd A. Gonzalez

[57] ABSTRACT

A method and apparatus in which an aluminum-clad copper pin-piston is supported on the upper surface of a roller or a pair of rollers. As the roller rotates, it rotates the pin-piston and the surface of the roller carries an electrolyte. The positive side of a power supply is connected to the pin-piston and the negative side of the supply is coupled to the roller surface via the electrolyte bath. Anodizing current passes from the rotating roller to the rotating pin-piston via the electrolyte, which is continuously replenished. An anodized film forms on the aluminum surface of the pin-piston. Oxide growth rate and film thickness are controlled by controlling the current density and the duration of pin-piston contact with the charged roller.

12 Claims, 2 Drawing Sheets

CONTINUOUS ANODIZING OF A CYLINDRICAL ALUMINUM SURFACE

BACKGROUND OF THE INVENTION

1. Field of the Invention

The present invention generally relates to a method and apparatus for anodizing the surface of a metallic cylinder, and more particularly to an improved method and apparatus for anodizing the surface of a bimetallic cylinder, such as an aluminum clad copper pin-piston, for use in a thermal conduction module.

2. Description of the Prior Art

U.S. Pat. No. 4,226,281 to Richard Chu entitled "Thermal Conduction Module" and assigned to the assignee of this application, discloses a module for transferring heat from semiconductor chips in which spring-loaded pin-pistons in contact with the chip transfer heat to housing referred to in the art as a piston hat. Commonly, aluminum pin-pistons are used in combination with an aluminum piston hat, and the pin-pistons are isolated electrically from the piston hat by anodizing the surface of the pin- piston or the surface of the piston hat that can contact the pin-piston. An anodized aluminum layer can provide good electrical isolation without significant degradation of heat transfer between the pin-piston and the piston hat.

Copper is a desirable material from which to fabricate pin-pistons and piston hats, owing to its greater coefficient of thermal conductivity as compared with that of aluminum. However, as a practical matter, it is difficult to electrically insulate copper pin-pistons from a copper pin hat.

Aluminum clad copper pin-pistons and pin hats are advantageous in that they provide a heat transfer coefficient comparable to copper and can be electrically isolated by anodizing the aluminum cladding surface, preferably the surface of the pin-piston. However, conventional anodizing processes cannot be used to anodize fabricated pin-pistons because the exposed copper ends of the pin-piston cannot be immersed in the anodizing electrolyte bath. Masking of the part to obtain selective anodization is not desirable because of cost and damage caused by handling.

SUMMARY OF THE INVENTION

An object of this invention is the provision of an improved method and apparatus for anodizing the aluminum surface of an aluminum clad copper pin- piston with exposed copper ends, and by extension, similar bimetal parts. A method and apparatus that provides selective anodizing without mechanical or chemical masking of the part. A continuous anodizing process that is cost effective and flexible.

Briefly, this invention contemplates the provision of a method and apparatus in which an aluminum-clad copper pin-piston is supported on the upper surface of a roller or a pair of rollers. As the roller rotates, it rotates the pin-piston and the surface of the roller carries an electrolyte. The positive side of a power supply is connected to the pin-piston and the negative side of the supply is coupled to the roller surface via the electrolyte bath. Anodizing current passes from the rotating roller to the rotating pin-piston via the electrolyte, which is continuously replenished. An anodized film forms on the aluminum surface of the pin-piston. Oxide growth rate and film thickness are controlled by controlling the current density and the duration of pin-piston contact with the charged roller. The present invention allows the aluminum surface of the pin-piston to be anodized without contact between the electrolyte and the exposed copper ends of the pin-piston.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1A:
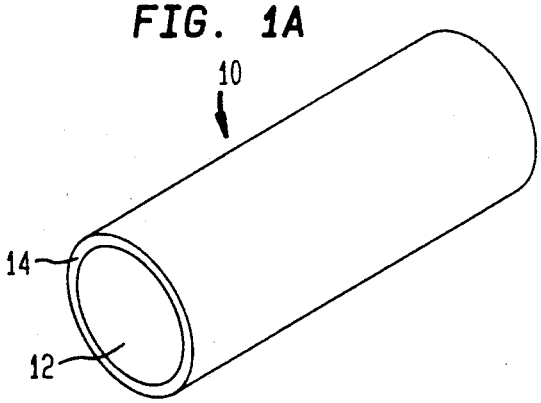
FIG. 1A is a perspective view of an aluminum-clad copper pin-piston.
Figure 1B:
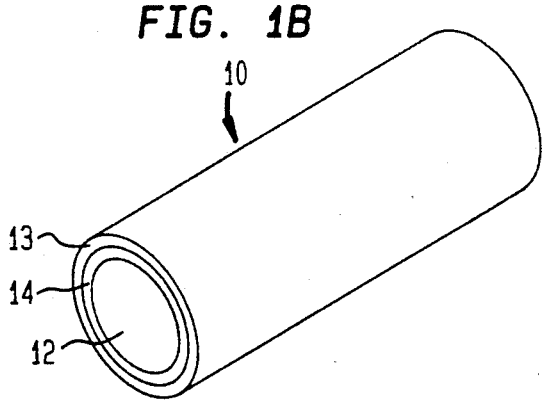
FIG. 1B is a perspective view of the pin-piston shown in FIG. 1A which has been anodized in accordance with the teachings of this invention.

Referring now to the drawings, FIG. 1A shows a typical pin-piston indicated by the general reference numeral 10 for which the anodizing system apparatus and method are particularly, although not exclusively, well suited. The pin-piston has a copper core 12 surrounded by an aluminum cladding layer 14 with the copper core exposed on both ends of the pin-piston. FIG. 1B shows an anodized pin-piston. Typical pin-piston dimensions are a core diameter of 6 millimeters, an aluminum cladding 13 with a thickness of 0.5 millimeters and pin-piston length of 12.7 millimeters. The anodized oxide film is typically on the order of 10 microns.

Figure 2:
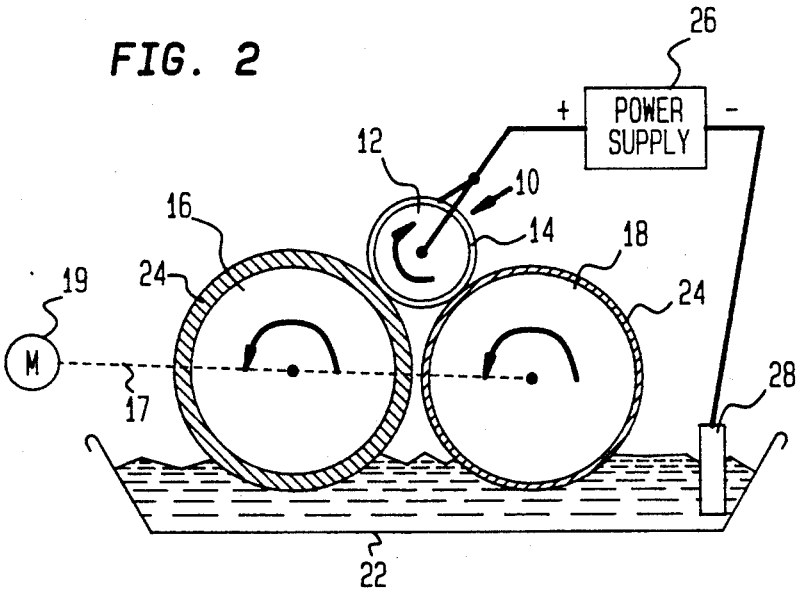
FIG. 2 is a schematic view of one embodiment of an anodizing system in accordance with the teachings of this invention.

FIG. 2 illustrates an anodizing system apparatus and method in accordance with the teachings of this invention. A pair of electrically insulating rollers 16 and 18 are rotatably mounted so that their peripheral surfaces are in contact, forming a cradle that supports a part whose surface is to be anodized, such as a pin-piston 10. A suitable drive 17 (e.g., a chain and sprocket drive) couples the rollers to a motor 19. In this embodiment the surfaces of the rollers are spaced from one another and both rollers rotate in one direction (here a counter-clockwise direction), driving the pin-piston 10 in an opposite directional sense. The diameter of the rollers is preferably on the order of two-to-three times the diameter of the part to be anodized. The length of the rollers 16 and 18 may be any convenient length relative to the length of the part. Several parts may be cradled along the length of the rollers and anodized simultaneously. In a typical anodizing process, the rollers rotate at about 50 revolutions per minute.

Figure 3:
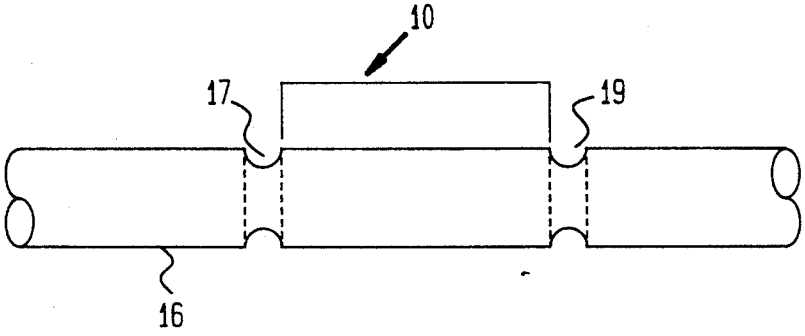
FIG. 3 is a fragmented detail view of a roller for use in the practice of the invention.

As they rotate, the surface of each roller passes through a suitable electrolyte bath 22, for example, a fifteen percent aqueous solution of sulfuric acid ($H_2SO_4$). The surface of each roller is so constructed that it provides a continuously replenishing electrolyte path from the bath 22 to the surface of the pin-piston 10 cradled between the rollers. In a preferred embodiment of the invention, the rollers are made of nylon or Teflon. The surface 24 of each roller is abraded to give a roughened surface that saturates with electrolyte. The surface may be abraded by grit blasting or machining. Alternatively, the roller surfaces are covered with a wicking material that saturates with electrolyte, such as, for example, a synthetic fabric or foam. Other methods can be used to transport electrolyte to the rotating pin-piston. For example, a hollow roller with perforations can be used. In this case, electrolyte will be injected into the hollow roller. In addition, as shown in FIG. 3, grooves 17 and 19 may be provided in the roller or rollers to prevent forming a meniscus at the ends of the pin-piston 10 which could cause electrolyte to contact the copper core. The inner edge of the grooves are spaced apart a distance equal to or very slightly less than the length of pin-piston 10.

The positive terminal of direct current power supply 26 is coupled to the core of the pin-piston 10, and the negative terminal is coupled to a cathode 28 immersed in the electrolyte bath 22. As will be appreciated by those skilled in the art, in the anodizing process, a current flowing from the cathode through the electrolyte carried by the surface of the rollers to the aluminum surface of the pin-piston, forms an oxide coating on the surface of the aluminum. The film thickness and oxide growth rate can be controlled by controlling the current density and the duration the pin-piston is in contact with the rollers.

Figure 4:
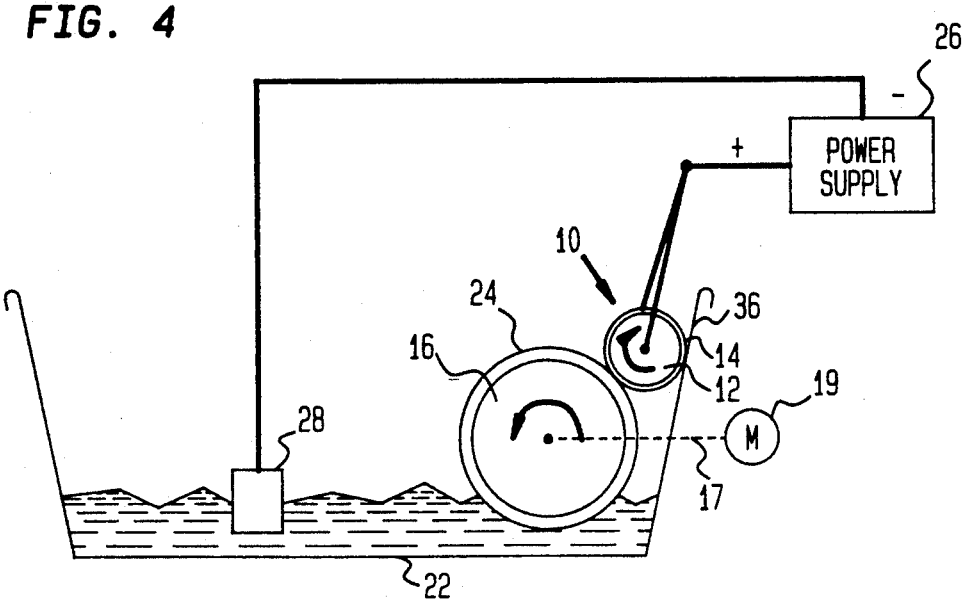
FIG. 4 is another schematic view similar to FIG. 2 of an alternate embodiment of the invention.

Referring now to FIG. 4, in this embodiment a single roller 16 is used; the construction of roller 16 and the operation of the anodizing system are essentially the same as has been described in connection with FIG. 2. Here, a pin-piston 10, or other similar part, is held against the surface of the roller 16 by a wall or fence 36 that can also act to wipe electrolyte from the surface of the part.

Figure 5:
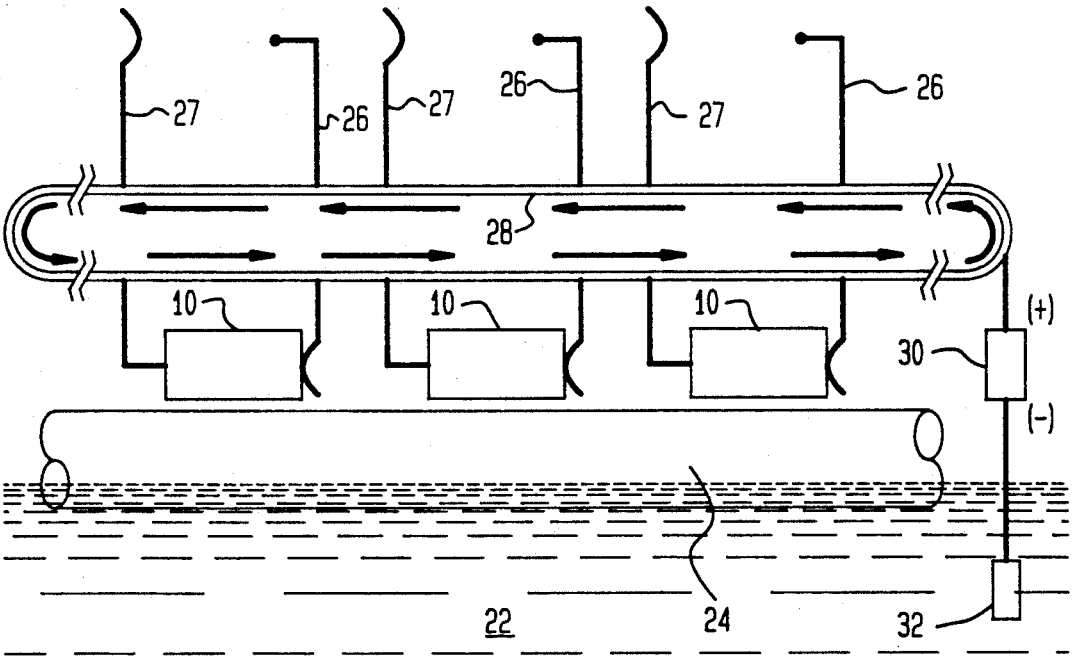
FIG. 5 is a schematic view of a continuous process for anodizing in accordance with the teaching of the invention.

Referring now to FIG. 5, this figure shows the teachings of the invention applied to a continuous process for anodizing a series of pins 10. Here a roller 24 of the type previously described rotates, and as it does, its surface passes through an electrolyte bath 22. Here an anode contact 26 and a cooperating spring 27 both attached to a conductive conveyor 28 engage the ends of pin-pistons 10. The positive terminal of a power supply 30 is connected to the conductive conveyer 28 to which the anode contacts 26 are mechanically and electrically coupled. The negative terminal of power supply 30 is coupled to an anode 32 in the electrolyte bath indicated schematically in the drawing. As the conveyor 28 moves, at the left end (in this example) a pin-piston 10 is inserted between contact 26 and spring 27. The roller 24 causes the pin-piston to rotate as the contact and spring carry the pin-piston along the length of the roller to this right-hand side, where it is discharged. The speed of the conveyor is controlled to provide a desired duration of the anodizing process.

While the invention has been described in terms of a single preferred embodiment, those skilled in the art will recognize that the invention can be practiced with modification within the spirit and scope of the appended claims.

Having thus described our invention, what we claim as new and desire to secure by Letters Patent is as follows:

1. An apparatus for selectively anodizing the peripheral surface of a cylindrical member comprising in combination:

a roller having a peripheral surface;

means for rotating said roller;

means for supporting said member so that said peripheral surface of said member is in contact with the peripheral surface of said roller and said contact causes said member to rotate as said roller rotates;

an electrolyte carried by said peripheral surface of said roller;

a cathode electrically coupled to electrolyte;

a power supply having a positive terminal and a negative terminal; and means for coupling said negative terminal to said cathode and means for coupling said positive terminal to said cylindrical member.

2. An apparatus for selectively anodizing the peripheral surface as in claim 1, wherein said means for supporting includes a second roller.

3. An apparatus for selectively anodizing the peripheral surface as in claim 1, wherein said means for supporting includes a conveyor that moves a series of cylindrical members continuously in a direction transverse to the rotation of said roller.

4. An apparatus for selectively anodizing the peripheral surface as in claim 1, further including grooves in said roller to prevent forming a meniscus at an end of said cylindrical member.

5. An apparatus for selectively anodizing the peripheral surface as in claim 1, wherein said peripheral surface of said roller is abraded.

6. A method for selectively anodizing the peripheral surface of a cylindrical member, including the steps;

supporting said cylindrical member on a peripheral surface of a roller so that said member rotates as said roller rotates;

rotating said roller;

forming a layer of electrolyte on said peripheral surface of said roller; and connecting the negative terminal of a power supply to a cathode in said electrolyte and the positive terminal of said power supply to said member.

7. An apparatus for selectively anodizing the peripheral surface of a cylindrical member comprising in combination:

a roller having a peripheral surface to which an electrolyte adheres as said roller rotates;

means for rotating said roller;

means for supporting said member so that said peripheral surface of said member is in contact with the peripheral surface of said roller and said contact causes said member to rotate as said roller rotates;

an electrolyte bath disposed so that a portion of said peripheral surface of said roller is immersed in said electrolyte bath;

a cathode in said electrolyte bath;

a power supply having a positive terminal and a negative terminal; and means for coupling said negative terminal to said cathode and means for coupling said positive terminal to said cylindrical member.

8. An apparatus for selectively anodizing the peripheral surface as in claim 7, wherein said means for supporting includes a second roller.

9. An apparatus for selectively anodizing the peripheral surface as in claim 7, wherein said means for supporting includes a conveyor that moves a series of cylindrical members continuously in a direction transverse to the rotation of said roller.

10. An apparatus for selectively anodizing the peripheral surface as in claim 7, further including grooves in said roller to prevent forming a meniscus at an end of said cylindrical member.

11. An apparatus for selectively anodizing the peripheral surface as in claim 7, wherein said peripheral surface of said roller is abraded.

12. A method for selectively anodizing the peripheral surface of a cylindrical member, including the steps;

supporting said cylindrical member on a peripheral surface of a roller so that said member rotates as said roller rotates;

rotating said roller;

passing a portion of said peripheral surface of said roller continuously through an electrolyte bath as said roller rotates; and connecting the negative terminal of a power supply to a cathode in said electrolyte and the positive terminal of said power supply to said member.

* * * * *